US006240953B1

(12) United States Patent
Laughlin et al.

(10) Patent No.: US 6,240,953 B1
(45) Date of Patent: Jun. 5, 2001

(54) MULTIPLE CLEANING CHEMICAL DISPENSER

(75) Inventors: Timothy E. Laughlin, Edina; Robert Grant, Eden Prairie, both of MN (US)

(73) Assignee: Sunburst Chemicals, Inc., Bloomington, MN (US)

( * ) Notice: Subject to any disclaimer, the term of this patent is extended or adjusted under 35 U.S.C. 154(b) by 0 days.

(21) Appl. No.: 09/290,743

(22) Filed: Apr. 13, 1999

Related U.S. Application Data

(60) Provisional application No. 60/081,593, filed on Apr. 13, 1998.

(51) Int. Cl.[7] ..... D06F 39/02

(52) U.S. Cl. ..... 137/268; 137/561 A; 137/890; 68/17 R; 68/207

(58) Field of Search ..... 222/132, 145.6; 137/268, 890, 897, 888, 889, 624.18, 561 A; 68/17 R, 12.18, 207

(56) References Cited

U.S. PATENT DOCUMENTS

| | | | | |
|---|---|---|---|---|
| Re. 32,818 | | 1/1989 | Fernholz et al. . | |
| 1,954,261 | | 4/1934 | Pierce . | |
| 2,308,612 | | 1/1943 | Lekmkuhl . | |
| 2,371,720 | | 3/1945 | Stine . | |
| 3,044,285 | | 7/1962 | Koplin . | |
| 3,160,317 | | 12/1964 | Hambro . | |
| 3,219,050 | | 11/1965 | Ericson . | |
| 3,319,637 | | 5/1967 | Gore et al. . | |
| 3,771,333 | | 11/1973 | Jurjans . | |
| 3,807,434 | | 4/1974 | Rasmussen et al. . | |
| 3,826,113 | * | 7/1974 | Boraas et al. | 68/12.18 |
| 3,881,328 | | 5/1975 | Kleimola et al. . | |
| 4,003,710 | * | 1/1977 | Fleckenstein et al. | 422/239 |
| 4,063,663 | | 12/1977 | Larson et al. . | |
| 4,103,520 | | 8/1978 | Jarvis et al. . | |
| 4,250,910 | | 2/1981 | King . | |
| 4,687,121 | | 8/1987 | Copeland . | |
| 4,690,305 | | 9/1987 | Copeland . | |
| 4,826,661 | | 5/1989 | Copeland et al. . | |
| 4,845,965 | * | 7/1989 | Copeland et al. | 68/17 R |
| 4,858,449 | | 8/1989 | Lehn . | |
| 4,932,227 | * | 6/1990 | Hogrefe | 68/17 R |
| 4,964,185 | | 10/1990 | Lehn . | |
| 4,995,418 | | 2/1991 | Cervola . | |
| 4,999,124 | | 3/1991 | Copeland . | |
| 5,014,211 | * | 5/1991 | Turner et al. | 364/479.09 |
| 5,147,615 | | 9/1992 | Bird et al. . | |
| 5,268,153 | | 12/1993 | Muller . | |
| 5,342,587 | | 8/1994 | Laughlin et al. . | |
| 5,435,157 | | 7/1995 | Laughlin . | |
| 5,478,537 | | 12/1995 | Laughlin et al. . | |
| 5,500,050 | * | 3/1996 | Chan et al. | 134/18 |
| 5,549,875 | * | 8/1996 | Laughlin et al. | 422/266 |
| 5,607,651 | | 3/1997 | Thomas et al. . | |
| 5,782,109 | | 7/1998 | Spriggs et al. . | |
| 5,799,831 | | 9/1998 | Spriggs et al. . | |
| 5,846,499 | | 12/1998 | Laughlin et al. . | |
| 5,915,592 | | 6/1999 | Mehus et al. . | |

* cited by examiner

*Primary Examiner*—A. Michael Chambers
(74) *Attorney, Agent, or Firm*—Patterson, Thuente, Skaar & Christensen, P.A.

(57) ABSTRACT

A cleaning chemical dispenser is provided. The dispenser includes bowl assemblies accommodating inverted containers with solid cast cleaning chemicals. The chemical dispenser generates cleaning chemical solutions by spraying a solvent such as water onto the solid cast concentrates. Concentrates from two of the containers are blended together, but are kept separate from the concentrate from the other container. All concentrate solutions are then further diluted in a venturi containing separate paths for each of the blended and separate solutions. The diluted solutions are then separately routed to the use container.

30 Claims, 9 Drawing Sheets

MULTIPLE CLEANING CHEMICAL DISPENSER

RELATED APPLICATION

This application claims priority under 35 U.S.C. § 119(e) to U.S. Provisional Application No. 60/081,593, filed Apr. 13, 1998, and incorporated herein in its entirety by reference.

FIELD OF THE INVENTION

The present invention relates to chemical dispensers for use in serving a single machine, such as a single laundry cleaning machine, which uses a plurality of chemicals. In particular the invention relates to a dispenser which services a single laundry cleaning machine by transporting multiple chemical solutions via unique and isolated conduits with the aid of a venturi pump.

BACKGROUND OF THE INVENTION

In a laundry a wide range of chemicals are used in cleaning cycles. In cases where chemicals are manufactured as solid casts, it is necessary to have a dispensing unit which can generate and deliver chemical cleaning solutions to a laundry cleaning machine. Generation and delivery of chemical cleaning solutions from the dispensing unit should be automatic, thereby requiring minimal operator assistance and minimizing the likelihood of hazard arising from blending incompatible solutions. Incompatible solutions include solution combinations which, when blended, are reactive and yield undesirable byproducts, such as a liberated toxic gas and an insoluble precipitate.

U.S. Pat. No. 5,342,587, issued to Laughing et al., Aug. 30, 1994 and hereby incorporated by reference, discloses a detergent dispenser for use with a solid cast detergent. A single valve is utilized to initiate a flow of a ready-to-use detergent solution that may be drawn off the container. The valve commences a flow of water which is split in a T-shaped fitting. An appropriate portion of the water is routed to spray on the solid cast detergent and dissolve the detergent, thereby generating a concentrated solution. The concentrated solution flows into a conduit where it is mixed with a second portion of the water, thereby diluting the solution to an appropriate concentration for use. A restricter located in the T-shaped fitting acts to split the flow of water appropriately to ensure the discharge solution is in a ready-to-use concentration.

U.S. Pat. No. 5,435,157, issued to Laughlin, Jul. 25, 1995 and hereby incorporated by reference, discloses a laundry chemical dispenser for use in servicing at least two laundry cleaning machines by dispensing a plurality of chemical agents utilized in the process of cleaning soiled laundry and wherein at least two of the chemical agents are compatible. The chemical dispenser has a plurality of chemical dispensing systems designed to deliver a selected chemical agent from a source to a washing machine. A chemical dispensing system is in flow communication with each chemical source and in flow communication with each washing machine. Each chemical dispensing system has a pump and a delivery conduit. For selected chemical agent delivery, the pump is a venturi injector pump. The chemical dispensing systems utilized for dispensing compatible chemical agents have a common portion and are fluidly independent from chemical dispensing systems utilized for dispensing incompatible chemical agents.

U.S. Pat. No. 5,478,537, issued to Laughlin et al., Dec. 26, 1995 and hereby incorporated by reference, discloses a detergent dispenser for use with a solid cast detergent. The detergent dispenser is coupled to a source of fluid and has a chemical source in solid cast form. A spray generator is designed to generate a fluid spray bearing on the chemical source, thereby generating a concentrated solution of the chemical. The concentrated solution of the chemical is discharged through a discharge conduit. A single valve controls a flow of fluid from the source of fluid. The valve has an inlet operably and fluidly coupled to the source of fluid, an outlet operably and fluidly coupled to the spray generator, and an outlet operably and fluidly coupled to the discharge conduit. A metering device for selectively metering portions of the flow of fluid to the spray generator and to the discharge conduit is disposed within the valve. The metering device selectively and fluidly couples the inlet to the outlet which is operably and fluidly coupled to the spray generator and to the outlet which is operably and fluidly coupled to the discharge conduit. A pressure feedback shutoff system is utilized to ensure that fluid flow to the spray generator is disabled at the time the flow in the discharge conduit is disabled.

U.S. Pat. No. 5,549,875, issued to Laughlin et al., Aug. 27, 1996 and hereby incorporated by reference, discloses a detergent dispenser for use with a solid cast detergent. The detergent dispenser is coupled to a source of fluid and has a chemical source in solid cast form. A spray generator is designed to generate a fluid spray bearing on the chemical source, thereby generating a concentrated solution of the chemical. The concentrated solution of the chemical is discharged through a discharge conduit. A single valve controls a flow of fluid from the fluid source. The valve has an inlet operably and fluidly coupled to the source of fluid, an outlet operably and fluidly coupled to the spray generator, and an outlet operably and fluidly coupled to the discharge conduit. A metering device for selectively metering portions of the flow of fluid to the spray generator and to the discharge conduit is disposed within the valve. The metering device selectively and fluidly couples the inlet to the outlet that is operably and fluidly coupled to the spray generator and to the outlet that is operably and fluidly coupled to the discharge conduit. A pressure feedback shutoff system is utilized to ensure that fluid flow to the spray generator is disabled at the time that the flow in the discharge conduit is disabled.

U.S. Pat. No. 5,846,499, issued to Laughlin et al., Dec. 8, 1998 and hereby incorporated by reference, discloses an air induction bowl for use with a detergent dispenser. The detergent dispenser uses an air induction bowl adapted to support an inverted container of solid cast chemical and has a jet for directing a spray of liquid on the solid cast chemical to generate a solution thereof. The chemical dispenser has a valve for control of the liquid supplied to the chemical dispenser, the valve being in flow communication with the jet. The bowl comprises a container receiver portion having an upwardly directed container opening defined. The jet is disposed in an accumulator portion of the bowl. A discharge portion of the bowl has an air induction opening in fluid communication with the accumulator portion.

There is then a need for a dispensing device which can generate and blend compatible cleaning solutions, yet separately generate and deliver incompatible solutions as well. There is also a need in the industry for a dispensing device which can perform these functions with a minimum number of components, thereby ensuring reliability and ease of maintenance.

SUMMARY OF THE INVENTION

The present invention substantially meets the aforementioned needs of the industry by providing a chemical dispensing device which manufactures a multiplicity of chemical cleaning solutions and transports them to a laundry cleaning machine via conduits which isolate solutions from one another. Such transport is effected by means of a multiple venturi pump. The dispensing device operates automatically in response to signals transmitted by the laundry cleaning machine and requires operator intervention only at those times when chemical supplies need to be replenished.

There is provided a device for dividing a fluid solvent into a supply stream and a plurality of dilution streams, the device including a fluid divider and a plurality of independent dilution stream pathways. The fluid divider may be configured to divide the fluid solvent into the supply stream and the plurality of dilution streams. The plurality of independent dilution stream pathways may include a first dilution stream pathway and a second dilution stream pathway, each dilution stream pathway independently accommodating one of the dilution streams and a portion of a concentrate fluid pathway and may include structure for generating a partial vacuum proximate the concentrate fluid pathway to draw a stream of concentrate fluid into the dilution stream pathway to dilute the concentrate fluid in the dilution stream pathway.

There is also provided a device for generating cleaning solutions by spraying a solvent on first, second, and third solid casts and dissolving a portion thereof, the solid casts being disposed in respective first, second, and third inverted containers. The device may blend compatible cleaning solutions and may separately deliver incompatible cleaning solutions to a cleaning machine. The device may include a divider-blender, a first solvent supply pathway, a second solvent pathway, separate first and second concentrated solution pathways, and separate first and second dilution pathways. The first solvent supply pathway may include apparatus for conveying a first stream of the solvent to the divider-blender. The second solvent pathway may include bowls accommodating the first, second, and third inverted containers and apparatus for conveying a second stream of the solvent from the divider-blender to each bowl. The separate first and second concentrated solution pathways may each include apparatus for conveying at least one concentrated solution generated proximate one of said bowls to the blender-divider. The separate first and second dilution pathways may be in fluid communication with respective first and second concentrated solution pathways. Each dilution pathway may include apparatus for diluting the concentrated solutions and for conveying the diluted solutions to the cleaning machine.

There is yet further provided a stream splitter for use in a laundry chemical dispenser. The stream splitter may include an inlet channel, a stream splitter, a first discharge channel, a first laundry discharge channel, and a second laundry discharge channel. The inlet channel may be fluidly couplable to source of fluid for conveying a flow of fluid. The stream splitter chamber may be fluidly coupled to the inlet channel. The first discharge channel may be fluidly coupled to the stream splitter chamber for discharging a portion of the flow of fluid. The first laundry discharge channel may be fluidly coupled to the stream splitter chamber at an upstream end and may be fluidly coupled to a source of a first laundry chemical solution downstream of the upstream end. The second laundry discharge channel may be fluidly coupled to the stream splitter chamber at an upstream end and may be fluidly coupled to a source of a second laundry chemical solution downstream of the upstream end.

There is still further provided a laundry chemical dispenser fluidly coupled to a source of diluting liquid. The dispenser may include at least two chemical solution generators and a stream splitter. The at least two chemical solution generators may selectively generate at least two chemical solutions and the at least two chemical solutions may be chemically interactive. The stream splitter may induct the at least two chemical solutions by a venturi effect and may dilute the at least two chemical solutions. The stream splitter may have a first independent discharge channel for discharging a diluted first chemical solution and a second independent discharge channel for discharging a diluted second chemical solution.

DETAILED DESCRIPTION OF THE DRAWINGS

Comprehension of the present invention can be gained through reference to the drawings in conjunction with a thorough review of the following explanation. In order to facilitate a full appreciation of the invention, an overview of an exemplary embodiment is initially provided.

This invention generates a plurality of separately channelled cleaning solutions such as bleach, soap and softener solutions, and dispenses the cleaning solutions to a site of final use, such as a commercial laundry machine. The cleaning solutions are generated by dissolving portions of solid cast formulations disposed in inverted containers. Portions of the solid cast formulations are dissolved by impinging a quantity of a fluid solvent, such as water, against the solid cast formulations. A plurality of cleaning solutions may be blended; however, two separate and isolated pathways to the site of final use are maintained for incompatible solutions.

Figure 1:
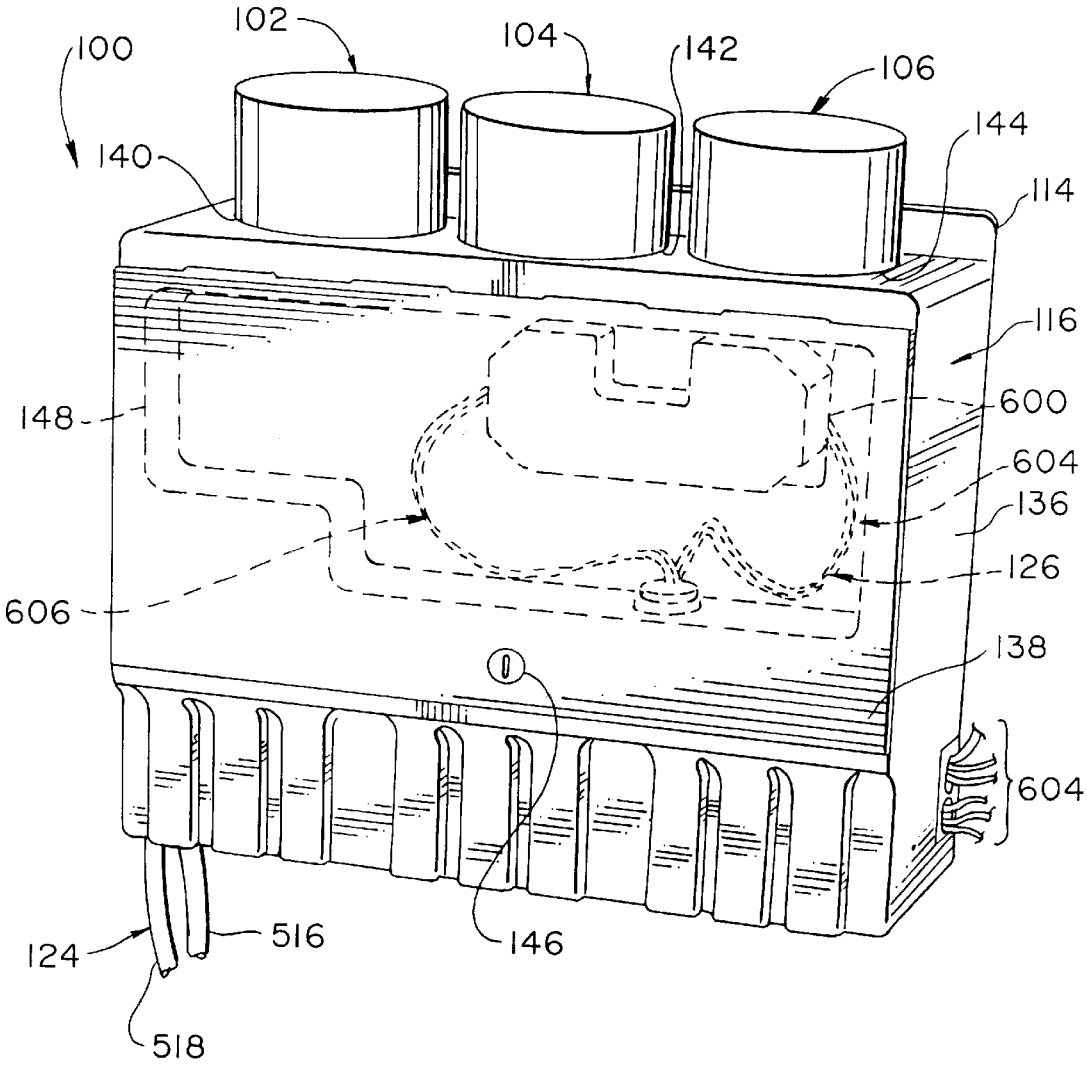
FIG. 1 is a perspective view of a multiple chemical dispenser of this invention.
Figure 7:
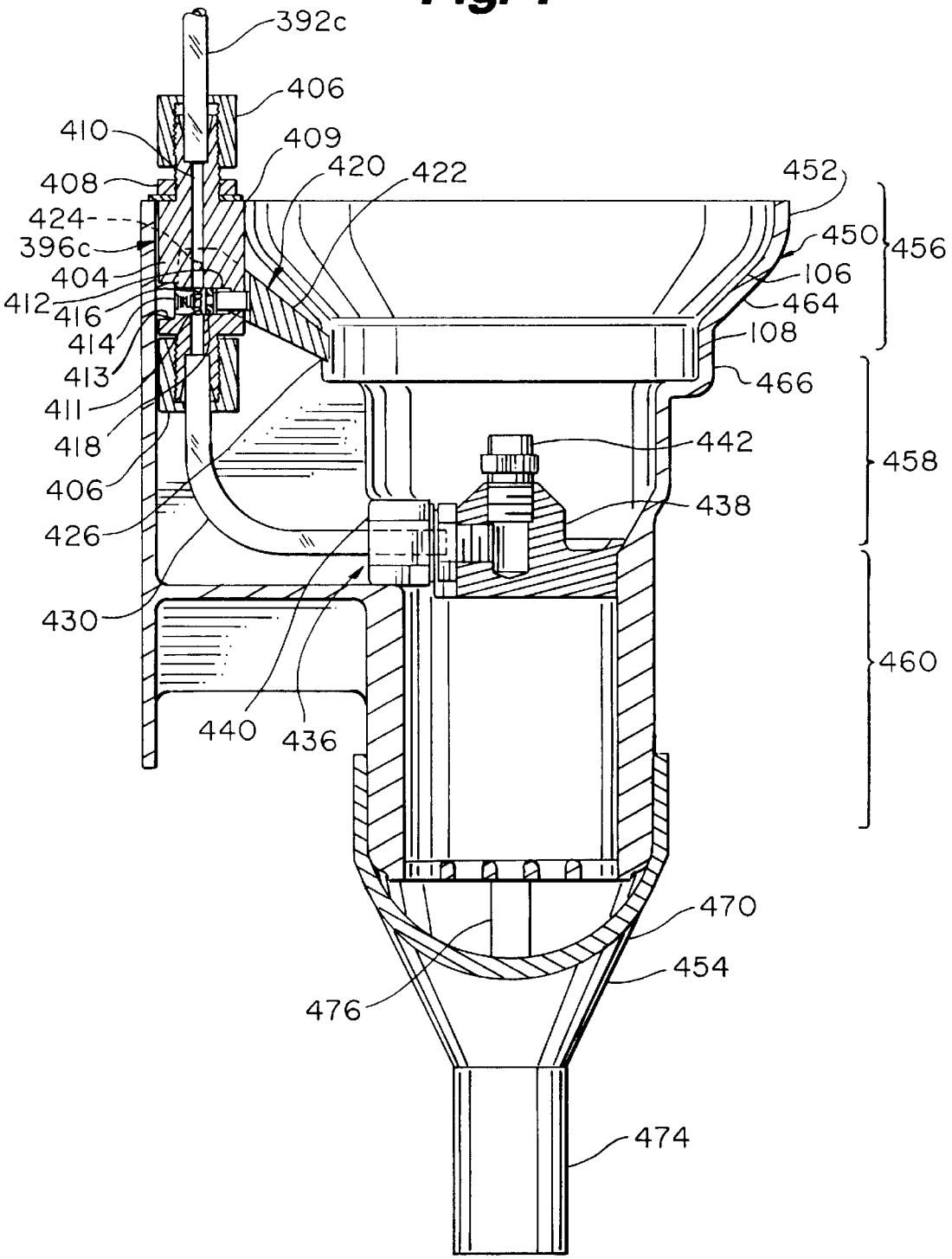
FIG. 7 is a cross-sectional view of a bowl assembly of FIG. 2 taken along lines 7—7.
Figure 8:
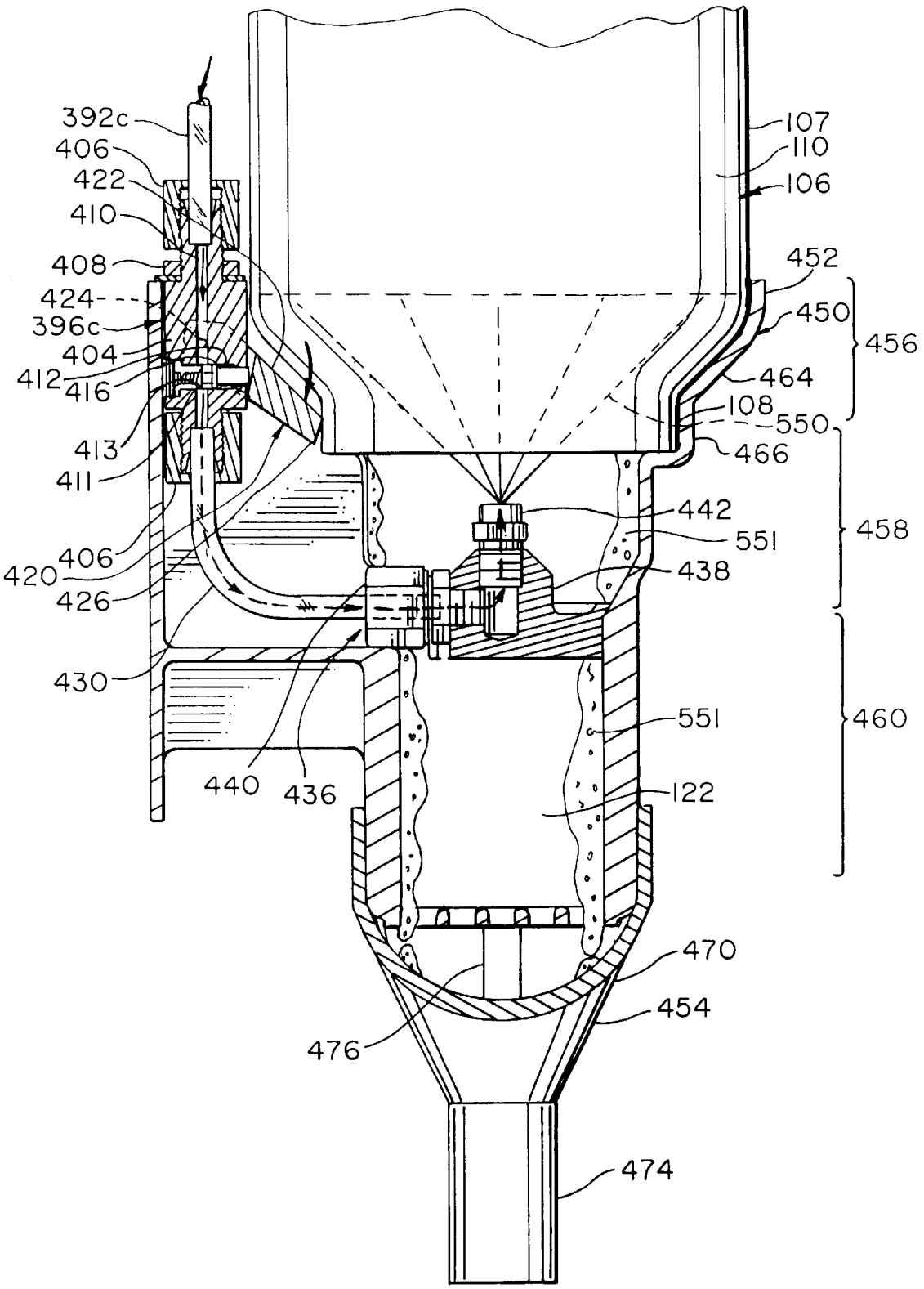
FIG. 8 is the cross-sectional view of the bowl assembly of FIG. 7 depicting a spray emitting from a spray nozzle and resultant chemical concentrate solution flowing through the bowl assembly.

Referring to FIGS. 1, 7, and 8, a multiple cleaning chemical dispenser of this invention is depicted generally at 100. Chemical dispenser 100 is shown with respective first, second, and third containers 102, 104, and 106 in position. The containers 102, 104, and 106 are substantially identical. As seen in FIG. 8, third container 106 includes main portion 107 narrowing to neck 108. Third container 106 contains solid cast cleaning chemical formulation 110. Such an exemplary cleaning formulation would be for a specific laundry sour/softener. Containers 102 and 104 may include other solid cast formulations such as detergent and bleach. Dispenser 100 generates cleaning chemical solutions from each container 102, 104, and 106 by impinging a quantity of solvent spray on the solid cast formulation 110. Compatible solutions, such as solutions generated simultaneously from respective first and second containers 102 and 104, may be blended together and delivered simultaneously. Alternatively, solutions may be generated either from container 102 or from container 104 and the resulting single solution delivered for use. However, some cleaning chemical solutions generated by this invention may be incompatible with other cleaning solutions also generated. For example, the solution generated from third container 106 may be incompatible with the cleaning chemical solutions generated from containers 102 and 104. This invention includes separate pathways to ensure that incompatible solutions can be separately generated and delivered, without undesirable byproducts having been synthesized.

Referring to FIGS. 1, 2, 3, and 4, chemical dispenser 100 broadly includes backplate 114, cover 116, water supply pathway 118, venturi divider-diluter 120, concentrated cleaning solution pathway 122, diluted cleaning solution pathway 124, and electrical system 126. Cover 116, water supply pathway 118, venturi dividerdiluter 120, concentrated cleaning solution pathway 122, diluted cleaning solution pathway 124, and portions of electrical system 126 are mounted on back plate 114, which may include a plurality of mounting holes 130. Fasteners such as screws are extended through mounting holes 130 to affix cleaning chemical dispenser 100 to a vertical element at a facility, such as a wall.

Cover 116, in turn, includes main cover portion 136 and door 138. Respective first, second, and third bowl openings 140, 142, and 144 are defined on a top surface of main cover portion 136. Door 138 optionally includes lock 146. Door seal 148 may be disposed on an inner surface of door 138. As can be seen in FIG. 1, inverted containers 102, 104, and 106 extend above respective bowl openings 140, 142, and 144 so that containers 102, 104, and 106 can easily be replaced when the solid casts therein have been depleted. Lock 146 may be present to restrict access the interior components of chemical dispenser 100.

Figure 2:
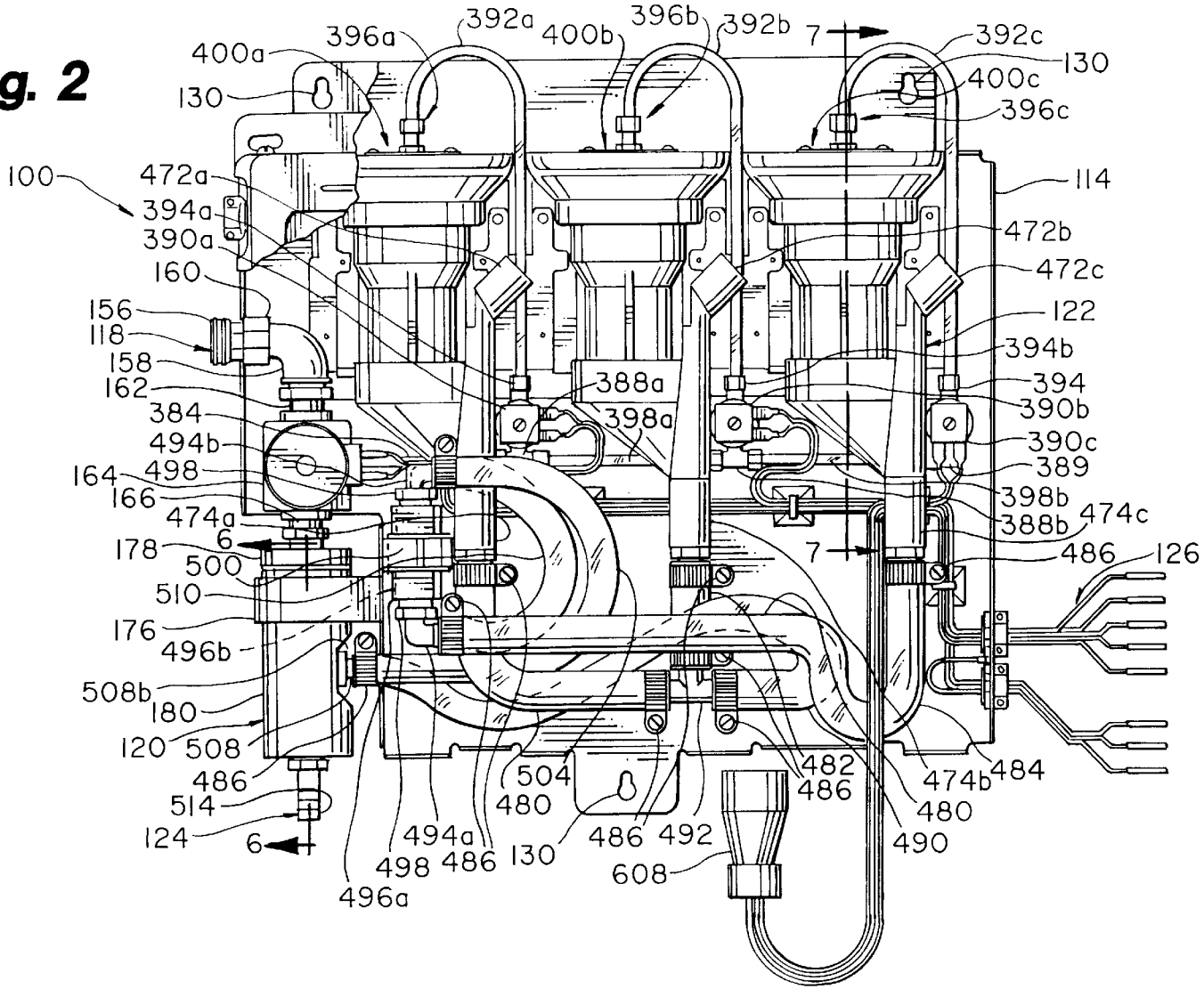
FIG. 2 is a front elevational view of the dispenser of FIG. 1 with the cover removed.
Figure 3:
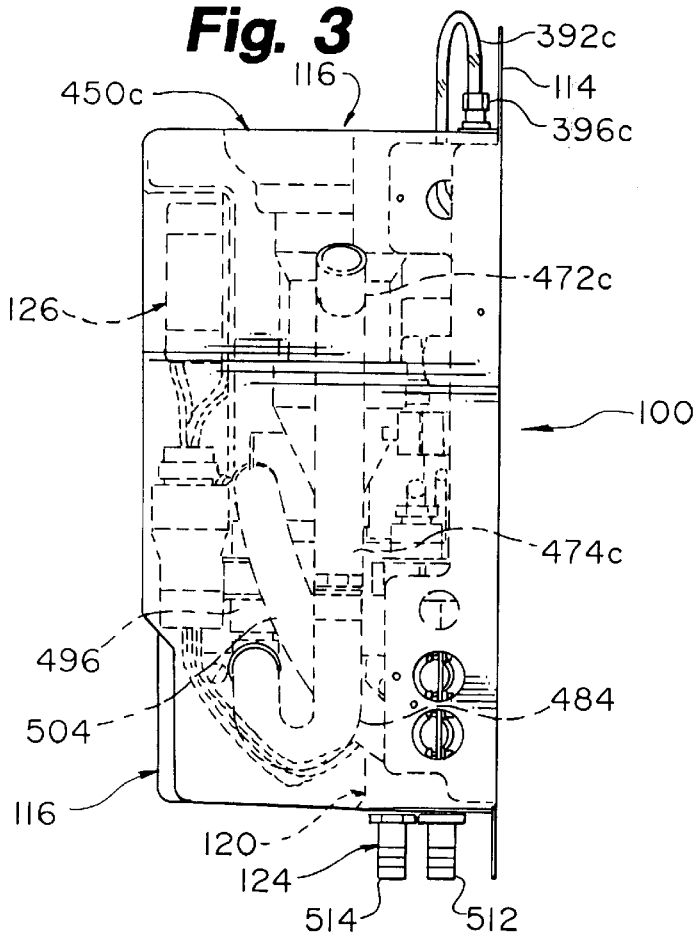
FIG. 3 is a side elevational view of the chemical dispenser of FIG. 2.

Referring to FIG. 2, water supply 118 conducts a fluid solvent such as water from an external source within the facility to venturi 120, then to the solid casts in containers 102, 104, and 106 where it is sprayed on the solid casts therein. The water source may provide water of a predetermined temperature to dispenser 100. In one embodiment, the water source is via a laundry-type hose attached to a faucet or spigot at the facility. Water supply pathway 118 begins at supply hose fitting 156. Present but not shown within supply hose fitting 156 may be a sealing element such as a hose washer and a screen filter. Supply hose fitting 156 is attached to an element such as elbow 158 by a fitting such as clamp 160. Exemplary supply hose fitting 156, clamp 160, and elbow 158 have inner diameters of preferably about ½" and are dimensioned to accommodate a typical laundry-type hose fitting. In this embodiment, elbow 158 is joined to exemplary reducing nipple 162. Reducing nipple 162 may reduce the inner diameter of water supply pathway 118 from ½" to ⅜" and conducts supply water to two-way solenoid 164. Water is admitted by a valve (not shown) through two-way solenoid 164, through conduit 166, and into venturi 120. The valve within two-way solenoid 164 is actuated by electrical system 126 as described below. Venturi 120 may be secured to back plate 114 by such devices as venturi clamp 176 and a fastener such as a screw or standoff.

Figure 5:
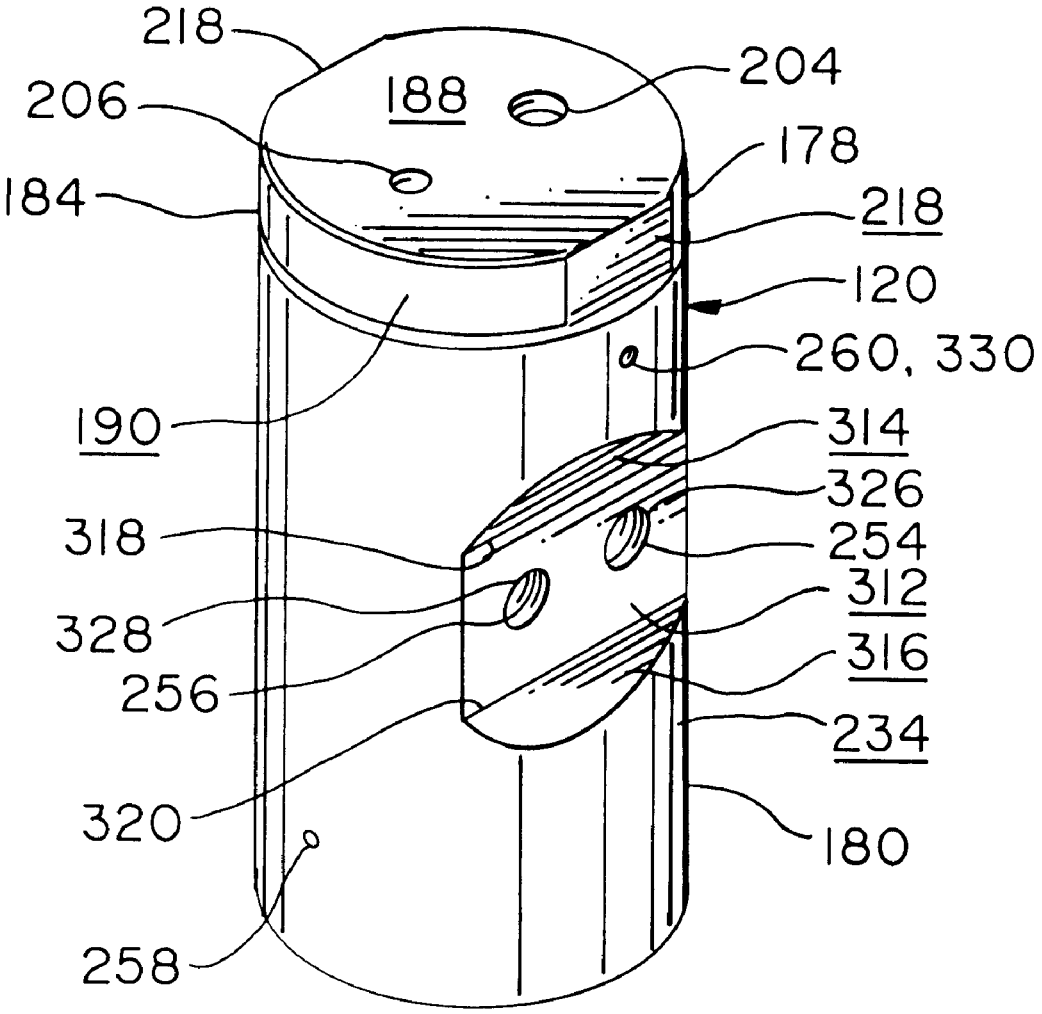
FIG. 5 is a perspective view of a divider-diluter used in the dispenser of FIG. 2.
Figure 6:
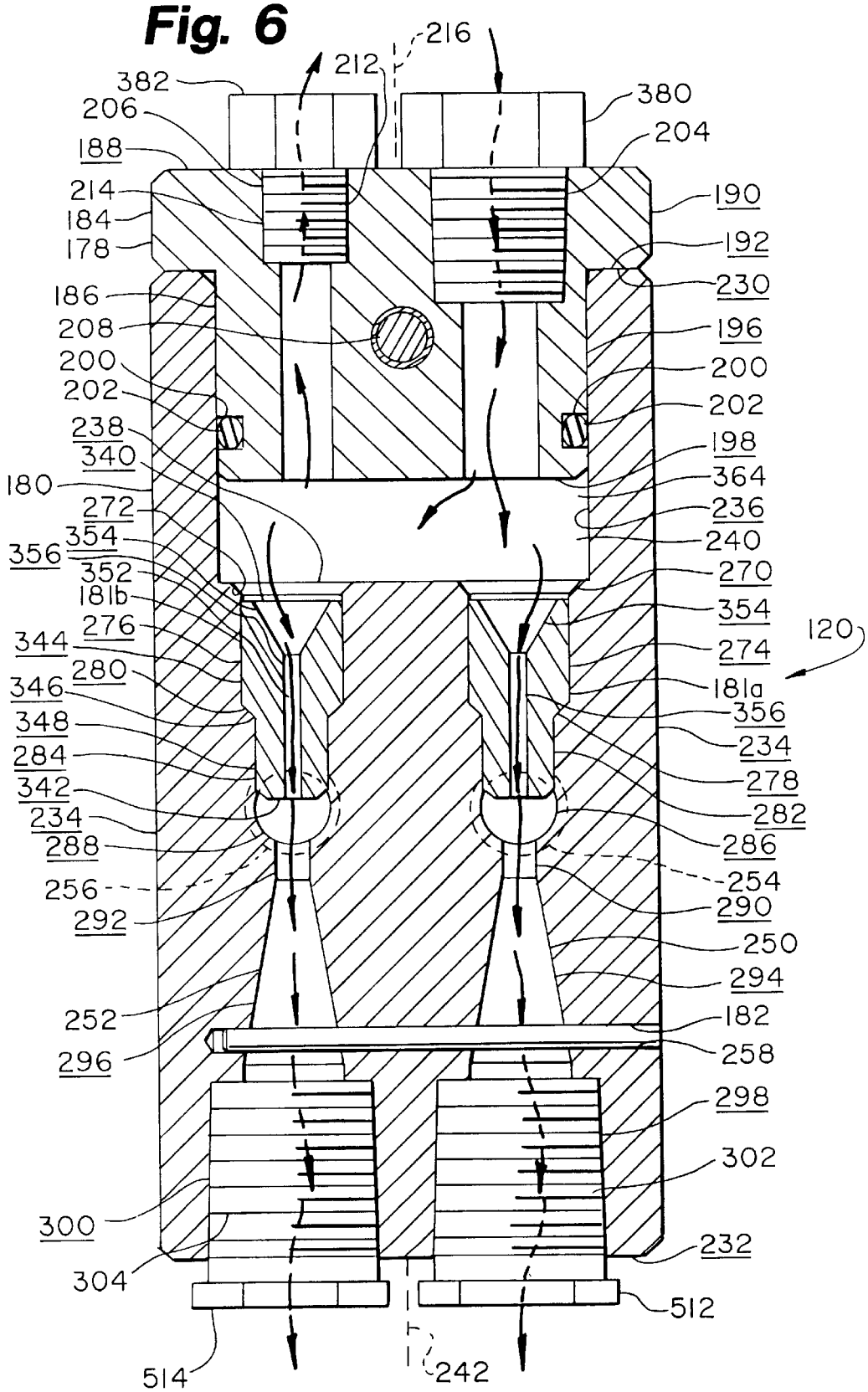
FIG. 6 is a cross-sectional view of the divider-diluter of FIG. 2 taken along lines 6—6.

Referring to FIGS. 2, 5, and 6, venturi 120 includes venturi cap 178, venturi body 180, and nozzle 181. In this embodiment, venturi cap 178 and venturi body 180 are each unitary. However, venturi cap 178 may be envisioned as including respective main cap portion 184 and depending portion 186. Main cap portion 184 displays first surface 188, first circumferential surface 190, and lip surface 192. Depending portion 186 of venturi cap 178, in turn, displays second circumferential surface 196, and lower margin 198. Circumferential groove 200 is defined in circumferential surface 196 proximate lower margin 198. Groove 200 is dimensioned to accommodate a sealing member such as O-ring 202. In this embodiment, main cap portion 184 and depending portion 186 are preferably between about 2.0" and 2.5" or about 2.363" (±0.005") and between about 1.5" and 2.0" or about 1.780" (±0.005") in diameter, respectively. The dimensions along longitudinal axis 216 of venturi cap 178 between first surface 188 and lower margin 198 is between about 1.25" and 1.75", or about 1.53" (±0.01") and the distance between first surface 188 and lip surface 192 is between about 0.25" and 0.75", or about 0.51" (±0.01"). The length of depending portion 186 is the distance between lip surface 192 and lower margin 198 and is between about 0.75" and 1.25", or about 1.02" (±0.01"). Groove 200 is between about 0.125" and 0.175", or about 0.158" (±0.005") in width and between about 0.1" and 0.2" or about 0.119" (±0.005") in depth. Groove 200 is disposed between about 0.175" and 0.25" or about 0.229" (±0.005") on center from lower margin 198.

Venturi cap 178 defines respective first and second bores 204 and 206, which extend between first surface 188 and lower margin 198. Depending portion 186 of venturi cap 178 defines generally diametrical third bore 208. Threads 212 and 214 are defined in respective first and second bores 204 and 206 proximate first surface 188. Respective first and second bores 204 and 206 are spaced apart, the longitudinal axis of each being between about 0.25" and 0.75", or about 0.47" (±0.01") from longitudinal axis 216 of venturi cap 178. First and second bores 204 and 206 are between about 0.25" and 0.50", or about 0.38" (±0.01" rand between about 0.15" and 0.35" or about 0.25" (±0.01") in diameter, respectively. Threads 212 and 214 of first and second bores 204 and 206 are configured and dimensioned to accept ⅜" and ⅛" fittings, respectively, and extend from first surface 188 between about 0.5" and 0.75" or about 0.68" (±0.01") and between about 0.25" and 0.75", or about 0.47" (±0.01"). Diametrically opposed flattened surfaces 218 may be defined on circumferential surface 190.

Body 180 of venturi 120 presents a generally cylindrical exterior, displaying generally opposing and respective first and second surfaces 230 and 232 and outer circumferential surface 234. Inner circumferential surface 236 extends between first surface 230 and third surface 238. Inner circumferential surface 236 and third surface 238 cooperate to define cavity 240 in part. In this embodiment, a longitudinal axis of cavity 240 is generally coaxial with longitudinal axis 242 of venturi body 180. Exemplary cavity 240 is between about 1.5" and 2.0" or about 1.8" (±0.005") in diameter and is between about 1.25" and 1.75" or about 1.53" (±0.01") in height as measured from first surface 230 to third surface 238. Also in this embodiment, longitudinal axis 216 of venturi cap 178 and the longitudinal axis of venturi body 180 are generally coextensive. Generally unitary venturi body 180 defines respective first and second passageways 250 and 252, respective first and second cavities 254 and 256, and respective first and second bores 258 and 260. First and second passageways 250 and 252 of venturi body 180 may generally align with respective first and second bores 204 and 206 of venturi cap 178 in this embodiment when venturi cap 178 is mated with venturi body 180.

Exemplary first and second passageways 250 and 252 are substantially identically dimensioned and configured. However, it is contemplated that first and second passageways 250 and 252 of differing dimensions and configurations are within the scope of this invention. First and second passageways 250 and 252 may be diametrically opposed. Longitudinal axes of first and second passageways 250 and 252 may be separated from longitudinal axis 216 of venturi body 180 by a distance of about 0.55" (±0.01") inches.

Extending from third surface 238 toward second surface 232, first and second passageways 250 and 252 are bounded by inner frustoconical surfaces 270 and 272, inner cylindrical surfaces 274 and 276, inner frustoconical surfaces 278 and 280, inner cylindrical surfaces 282 and 284, inner generally arcuate surfaces 286 and 288, inner cylindrical surfaces 290 and 292, inner frustoconical surfaces 294 and 296, and inner cylindrical surfaces 298 and 300. Threads 302 and 304 may be displayed and further define portions of respective passageways 250 and 252 defined by cylindrical surfaces 298 and 300. Inner surfaces 270 and 272 and surfaces 278 and 280 represent chamfering between third surface 238 and inner surfaces 274 and 276 and between inner surfaces 274 and 276 and respective inner surfaces 282 and 284. Inner surfaces 270, 272, 278, and 280 may represent a chamfering of about 45° (±1°) extending between about 0.05" and 0.08", between about 0.06" and 0.07", about 0.06" (±0.01"), or about 0.07" (±0.01") from adjoining third surface 238 and surfaces 274 and 276 and between surfaces 274 and 276 and surfaces 282 and 284. First and second passageways 250 and 252 are between about 0.25" and 0.75" or about 0.493" (±0.005") in diameter when defined by surfaces 274 and 276 and between about 0.15" and 0.65" or about 0.352" (±0.005") in diameter where defined by surfaces 282 and 284. First and second passageways 250 and 252 have diameters of between about 0.30" and 0.45", or about 0.38" (±0.01") where defined by inner surfaces 286 and 288 and diameters of between about 0.15" and 0.2" or about 0.173" (±0.005") where defined by inner surfaces 290 and 292. Cross sectional dimensions of passageways 250 and 252 defined by surfaces 294 and 296 increase from a diameter of between about 0.15" and 0.2" or about 0.173" (±0.005") to a diameter of between about 0.25" and 0.75" or about 0.50" (+0.01") as surface 232 is approached. Opposing inner surfaces 294 and 296 may diverge at an angle of between about 15° and 25° or about 20° (±1°). The portions of first and second passageways 250 and 252 defined by inner surfaces 298 and 300 and threads 302 and 304 are dimensioned and configured to accept a ½" fitting.

A cutout may be present on venturi body 180, interrupting otherwise generally cylindrical circumferential surface 234. The cutout includes generally planar surface 312 extending about 1.12" (±0.01" ) between inclined surfaces 314 and 316. Inclined surfaces 314 and 316 may extend from planar surfaces 312 at angles of about 45° (±1°). A first edge 318 of planar surface 312 extends about 2.11" (±0.01" ) from first surface 230 and second edge 320 of planar surface 312 extends about 1.70" (±0.01") from second surface 232. A middle portion of planar surface 312 tangentially extends from longitudinal axis 242 of venturi body 180 about 0.81" (±0.01") inches.

Bores 254 and 256 extend between planar surface 312 and the portion of passageways 250 and 252 bounded by inner spherical surfaces 286 and 288. Threads 326 and 328 further define respective bores 254 and 256. Threads 326 and 328 extend about 0.58" (±0.01") from planar surface 312 in this embodiment. In some embodiments, portions of bores 254 and 256 extending beyond respective threads 326 and 328 coextend with the portion of passageways 250 and 252 bounded by inner surfaces 286 and 288. Portions of bores 254 and 256 bounded by inner surfaces 286 and 288 may include radii of about 0.38" (+0.01") inches.

As shown in FIGS. 5 and 6, first bore 258 diametrically extends from circumferential surface 234 such that portions of first bore 258 are coextensive with portions of passageways 250 and 252 bounded by respective inner surfaces 294 and 296. In this embodiment, first bore 258 is about 0.0125" (±0.005") in diameter and extends from circumferential surface 234 about 2.14" (±0.01"). A longitudinal axis of first bore 258 extends about 1.10" (±0.01") from second surface 232 in this embodiment.

Second bore 260 extends between circumferential surface 234 and inner circumferential surface 236. Second bore 260 is disposed such that it aligns with third bore 208 of venturi cap 178 when depending portion 186 of venturi cap 178 is disposed within cavity 240 defined by venturi body 180. The portion of second bore 260 proximate inclined surface 314 may be defined by threads 330. Exemplary second bore 260 and threads 330 are dimensioned and configured to accommodate a ¼" standard machine screw. Third bore 208 of venturi cap 178 and second bore 260 are present in venturi 120 only to accommodate a fastening device to secure venturi cap 178 to venturi body 180. Third bore 208 and second bore 260 do not accommodate any fluids during operation of dispenser 100.

Nozzles 181*a* and 181*b* are dimensioned and conformed to be accommodated by portions of passageways 250 and 252 defined by respective inner surfaces 274 and 276, 278 and 280, and 282 and 284. In this embodiment, nozzles 181*a* and 181*b* are substantially identical. However, nozzles of differing dimensions and configurations are within the scope of this invention. Nozzles 181*a* and 181*b* display end first and second surfaces 340 and 342, outer first cylindrical surface 344, outer frustoconical surface 346, and outer second cylindrical surface 348 and defines bore 352. Bore 352, in turn, extends between first and second surfaces 340 and 342 and is defined by inner frustoconical inner surface 354 and inner generally cylindrical surface 356. Frustoconical inner surface 354 may diverge outwardly at an angle of between about 55° and 65° or about 60° (±1°) from a diameter of between about 0.08" and 0.09" or about 0.086" (±0.005") to a diameter of between about 0.35" and 0.45" or about 0.39" (±0.005") and extend between about 0.2" and 0.3" or about 0.26" (±0.01") from the portion of bore 352 bounded by inner cylindrical surface 356. The portion of nozzles 181*a* and 181*b* defined by outer first cylindrical surface 344 is between about 0.4" and 0.6" or about 0.494" (±0.005") in diameter. The portion of nozzles 181*a* and 181*b* bounded by outer second cylindrical surface 348 is between about 0.3" and 0.4" or about 0.344" (±0.005") in diameter. The portion of bore 352 bounded by cylindrical inner surface 356 is between about 0.07" and 0.09" or about 0.086" (±0.005") in diameter. The length of nozzles 181*a* and 181*b* may be determined by the distance between first and second surfaces 340 and 342 and is between about 0.9" and 1.1" or about 1.01" (±0.01") in this embodiment. Nozzle 181*a* is disposed in passageway 250 and nozzle 181*b* is disposed in passageway 251 as depicted in FIG. 6.

Diffuser 182 is conformed and dimensioned to be snugly accommodated in first bore 258. Diffuser 182 is further conformed and dimensioned so that fluid communication does not exist between first and second passageways 250 and 252 when diffuser 182 is disposed in first bore 258. Exemplary and generally cylindrical diffuser 182 is between about 2.9" and 3.3" or about 3.10" (±0.01") in length and between about 0.10" and 0.15" or about 0.125" (±0.005") in diameter in this embodiment.

As can be seen in FIG. 6, venturi cap 178 and venturi body 180 cooperate to define dividing chamber 364 when depending portion 186 of venturi cap 178 is disposed in cavity 240 of venturi body 180. A solvent or fluid, such as water, entering venturi 120 via first (ingress) bore 204 flows into dividing chamber 364. From dividing chamber 364, the water flows from venturi 120 via second (egress) bore 206 to the remainder of water supply pathway 118. Water also flows from dividing chamber 364 into passageways 250 and 252. As is known in the art, passageways 250 and 252 cooperate with respective nozzles 181*a* and 181*b* disposed therein to generate a partial vacuum at passageway portions bounded by inner surfaces 286 and 288 when a fluid flows through passageways 250 and 252. These partial vacuums are also present in first and second cavities 254 and 256 because portions of respective passageways 250 and 252 bounded by inner surfaces 286 and 288 intersect first and second cavities 254 and 256. Venturi body 180 further functionally cooperates with diffuser 182 to mix water present in passageways 250 and 252 with fluids entering passageways 250 and 252 from respective first and second cavities 254 and 256. Diffuser 182 extends across portions of passageways 250 and 252 bounded by respective inner surfaces 286 and 288 and thus partially obstructs passageways 250 and 252 at these locations, thereby swirling and mixing fluids flowing through passageways 250 and 252.

Referring to FIGS. 2 and 6, water supply pathway 118 enters venturi 120 from conduit 166 through fitting 380, extends through first bore 204 and continues through dividing chamber 364 as explained below. Fitting 380 is configured and dimensioned to be accommodated by threads 212 proximate first bore 204.

A portion of the water entering dividing chamber 364 is discharged from venturi 120 through second bore 206. Water entering second bore 206 passes through fitting 382 and into a length of tubing to be conducted to a bowl assembly as discussed below. In this embodiment, fitting 382 is dimensioned and configured to be accommodated by threads 214 of second bore 206 and is a standard fitting with a ⅛" inner diameter joined to tubing 384.

Referring to FIG. 2, after passing through venturi 120, water supply pathway 118 first branches off at left three-way branch tee 388*a*. In one path, water supply pathway 118 continues through two-way solenoid valve 390*a* through tubing 392*a*. Tubing 392*a* is joined to two-way solenoid valve 390*a* by a fitting such as compression tube adapter 394. Tubing 392*a* extends between compression tube adapter 394 and left spray shut-off valve assembly 396*a*.

Proceeding in a second path, water supply pathway 118 further continues from left three-way branch tee 388*a* through tubing 398*a* to middle three-way branch tee 388*b* where water supply pathway 118 again branches off through middle two-way solenoid valve 390*b* and middle tubing 392*b* to middle spray shut-off assembly 396*b*.

Water supply pathway 118 further continues from middle three-way branch tee 388*b* through tubing 398*b* to elbow 389 connected to right two-way solenoid valve 390*c* and extends through right tubing 392*c* to right spray shut-off assembly 396*c*. Tubing 384, 392*a, b, c*, and 398*a, b*, three-way branch tees 388*a, b, c* and solenoids 390*a, b, c* have inner diameters of about ⅛" in this embodiment. Tubing 384, 392*a, b, c*, and 398*a, b* may be made from a synthetic resin such as polyethylene or from other materials known to the art.

Figure 4:
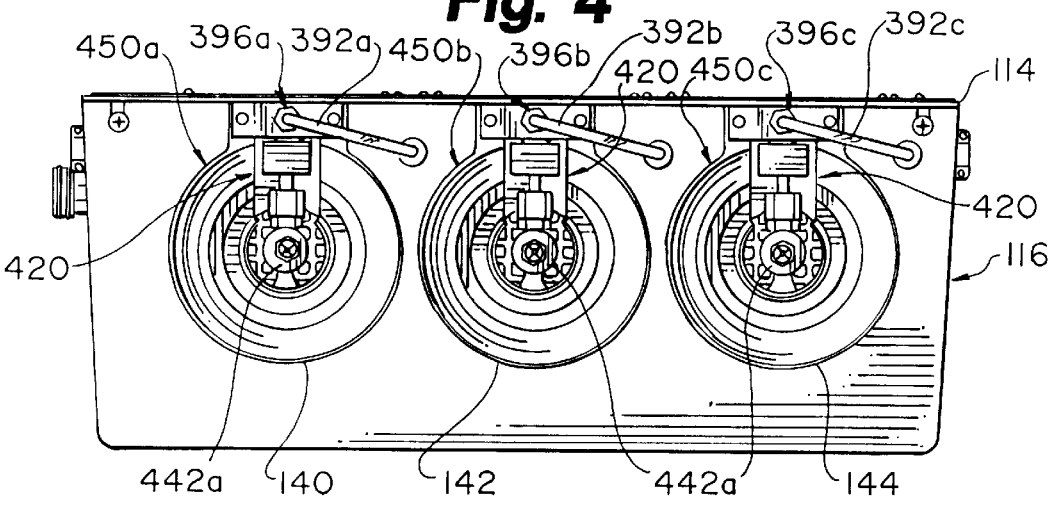
FIG. 4 is a top plan view of the chemical dispenser of FIG. 1.

Left, middle, and right spray shut-off assemblies 396*a, b, c* are substantially identical in this embodiment and may be viewed in FIGS. 4, 7, and 8. FIGS. 7 and 8 relate specifically to bowl assembly 400*c*. It is noted that bowl assemblies 400*a*, 400*b* are essentially identical to bowl assembly 400*c*, and the description of FIGS. 7 and 8 relates to bowl assemblies 400*a*, 400*b* as well. Tubing 392*c* is fixed to shut-off valve body 404 of shut-off valve assembly 396*c* by tube nut 406. Shut-off valve assembly 396*c* may be affixed to bowl assembly 400*c* of this invention by using a fastener such as jamb nut 408. Shut-off valve body 404 defines spray nozzle retainer 409, generally central bore 410, and generally transverse bore 411. Restriction 412 is proximate one end of transverse bore 411. Shut-off plug 413 is present proximate transverse bore 411 generally opposite restriction 412 and retains spring 414 and spool 416 within transverse bore 411. A portion of spool 416 extends through restriction 412. O-ring 418 is present about spool 416.

Shut-off valve actuator assembly 420 is also included in shut-off valve assembly 396*c*. Shut-off valve actuator assembly 420 includes lever 422 and pivot pin 424. Lever 422 is pivotally mounted to shut-off body 404 by means of pivot pin 424. Spring 414 biases spool 416 against lever 422 such that distal end 426 of lever 422 is generally biased away from the remainder of shut-off valve assembly 396. Another tube nut 406 connects shut-off valve assembly 396*c* to tube 430. Exemplary tube 430 has an inner diameter of ⅜" and is joined to spray nozzle holder 438 by means such as compression union 440. Nozzle 442 is threadably received with spray nozzle holder 438.

Referring to FIG. 2, each of containers 102, 104, and 106 is held in place by means of bowl assemblies 400*a*, 400*b*, 400*c*, respectively. Referring to FIGS. 7 and 8, concentrated solution pathway 122 begins in bowl assembly 400*c*. Bowl assembly 400*c* broadly includes bowl 452 and outlet 454. Bowl 452, in turn, includes container receiver portion 456, solution accumulator portion 458 and discharge portion 460. Container receiver portion 456 includes bowl body 464 and bowl neck portion 466. Bowl body 464 narrows to bowl neck portion 466 to accommodate and receive a container neck portion such as described above with respect to neck 108 of third container 106. Chemical receiver portion 456 accommodates and positions shut-off valve assembly 396*c* such that lever 422 will be pivoted toward the remainder of shut-off valve assembly 396 when container 106 is in place in bowl assembly 400*c*, thereby opening shut-off valve assembly 396*c* and allowing a fluid to flow therethrough. Spray assembly 436 is substantially disposed within solution accumulator 458 in this embodiment. Discharge portion 460 extends from solution accumulator portion 458 and extends into funnel 470 of outlet 454 when funnel 470 is in place.

Referring to FIGS. 2, 7, and 8, in addition to funnel 470, outlet 454 includes vent 472, and conduit 474. Vent 472 unitarily joins funnel 470 in this embodiment. Also in this embodiment, conduit 474 unitarily depends from vent 472. Bowl 452 and outlet 454 may be joined by means interconnect slot 476 present in outlet 454 and a structure (not shown) complementary to interconnect slot 476 present on an outside surface of discharge portion 460 of bowl 452. The complementary structure slidingly mates with interconnect slot 476 in this embodiment.

Referring again to FIG. 2, tubing members 480, 482, and 484 attach to respective left, center, and right conduits 474*a*,

*b, c* by such fastening means as hose clamp 486. Tubing members 480 and 482 are connected to tubing member 490 by means of T-fitting 492 and such fastening means as hose clamps 486. Tubing member 484, connected to right conduit 474*c*, is connected to elbow 494*a* by such fastening means as hose clamp 486. Elbow 494*a* is in fluid communication with check-valve assembly 496*a* by such means as coupler 498.

Tubing member 490 is also connected to a second check-valve assembly 496*b* in this embodiment. An attaching member such as pipe clamp 500 is disposed about first and second check-valve assemblies 496*a, b*. Pipe clamp 500 may be secured to back plate 114 by a fastener such as a screw. A second elbow 494*b* attaches to first check-valve assembly 496*a* by means of coupler 498. Tubing member 504 is attached to elbow 494*b* by means of hose clamp 486. Tubing member 504 extends from elbow 494*b* and is attached to first fitting 508 by hose clamp 486. First fitting 508, in turn, is threadably received within second cavity 256 of venturi body 180. In a similar manner, tubing 490 is in fluid communication with a second check-valve assembly 496*b*. Second check valve assembly 496*b* is substantially similar to first check valve assembly 496*a* in this embodiment. A tubing member 510 proceeds from the second check-valve assembly 496*b* and is attached to a second fitting 508*b*. Second fitting 508*b* is disposed immediately behind first fitting 508 in FIG. 2. Second fitting 508*b* is threadably disposed within first cavity 254 of venturi 120. Tubing members 480, 482, 484, 490, 504, and 510 are preferably made from a synthetic resin such as ⅝" polyvinyl in this embodiment. However, other suitable materials are known to the art.

As the concentrated solutions 551 generated by exposing the solid casts within the inverted containers 102, 104, and 106 to water sprays 550 (See FIG. 8) enter first and second cavities 254 and 256, concentrated solution pathway 122 concludes and diluted solution pathway 124, leading to a using device such as a laundry machine, begins.

Referring to FIG. 6, as discussed above, first and second cavities 254 and 256 are in fluid communication with portions of respective first and second passageways 250 and 252 bounded by inner surfaces 286 and 288. Fittings 512 and 514 are threadably disposed within the portions of first and second passageways 250 and 252 defined by surfaces 298 and 300. Tubing members 516 and 518 may be attached to respective fittings 512 and 514 (FIG. 1). Tubing members 516 and 518 thereby extend from fittings 512 and 514 to a use machine, such as a commercial laundry machine.

Figure 9:
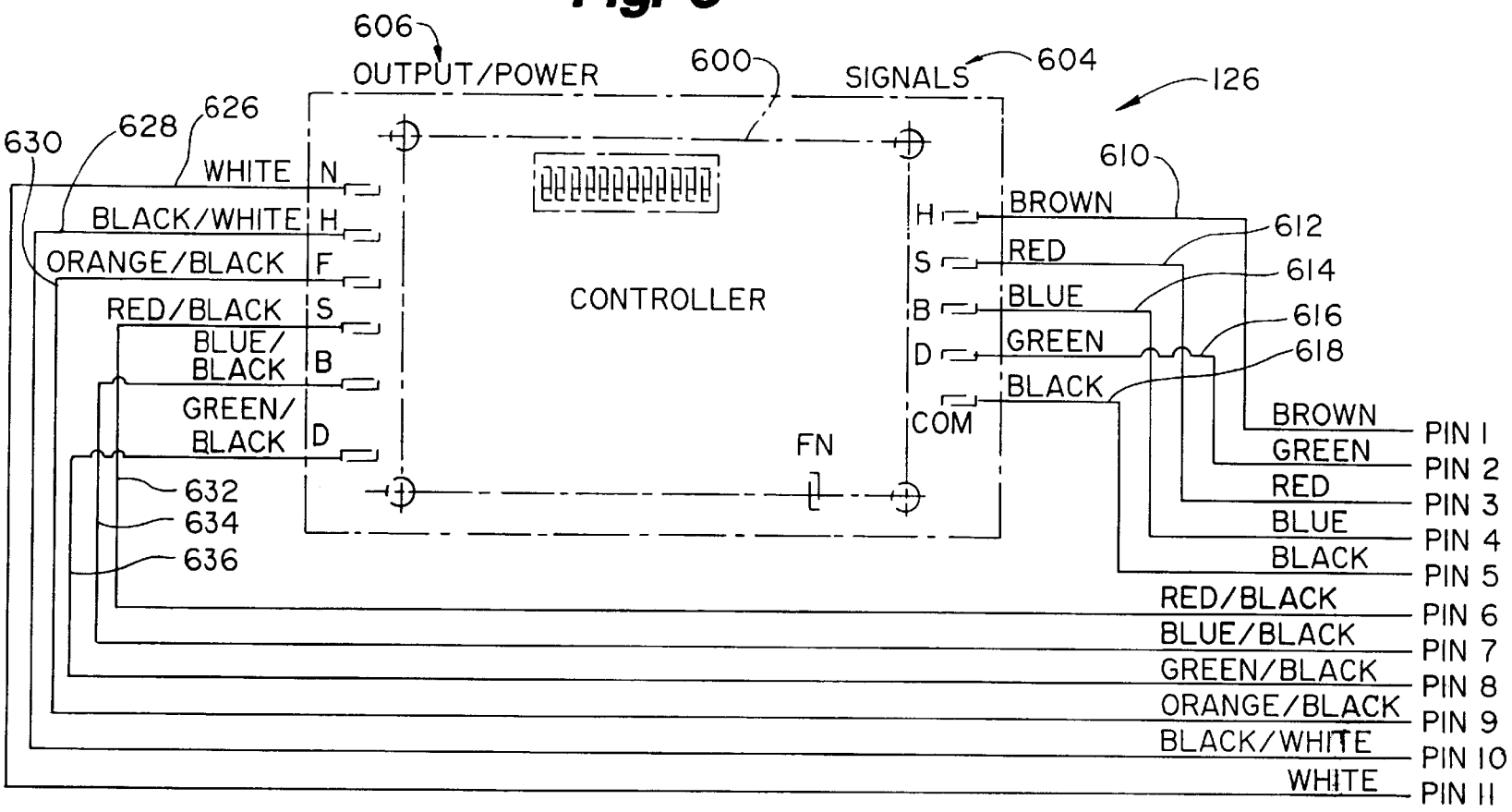
FIG. 9 is a schematic of the wiring diagram of the multiple chemical dispenser of FIG. 1.
Figure 10:
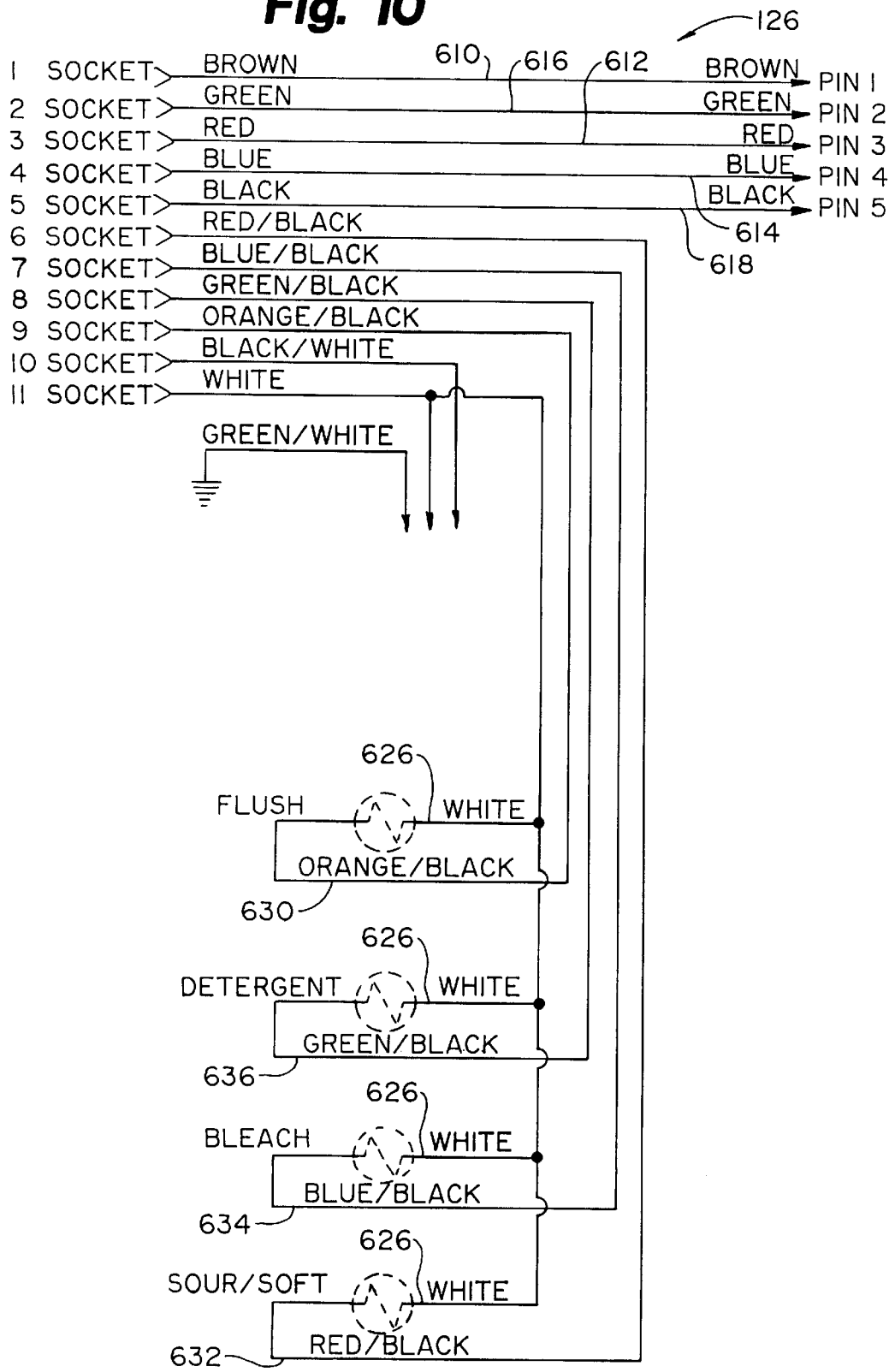
FIG. 10 is a schematic depicting the wiring arrangement of the multiple chemical dispenser of this invention.

As depicted in FIG. 9, electrical system 126 broadly includes controller 600, signal circuit 604, output/power circuit 606, and connector 608. Signal circuit 604, in turn, includes arbitrarily colored wires extending from a use machine, such as a commercial laundry machine, to contacts on controller 600. Arbitrarily colored wires included in exemplary signal circuit 604 include wires color-coded as brown 610, red 612, blue 614, green 616, and black 618. White colored wires signify a return or low side of power in this embodiment.

Output/power circuit 606 extends between solenoids 164 and 390*a, b, c* and contacts on controller 600. Exemplary and arbitrarily color-coded wires included in output/power circuit 606 are white 626, black/white 628, orange/black 630, red/black 632, blue/black 634, and green/black 636. In this embodiment, black/white signifies wires transmitting power, i.e., the high side of power. Wires 610–618 of signal circuit 604 cooperate to send four separate inputs from the laundry machine to controller 600 in a common 24–240 VAC current with a constant signal extending between about 5 and 10 seconds before signal recognition. Connector 608 may provide a simultaneous quick connect for all wires extending between controller 600 and the wiring present proximate surface 114 in this embodiment.

Signal duration after recognition may be either continuous or momentary. Signals generated from the laundry machine may include the following exemplary inputs: detergent, bleach, sour/softener, and high formula select. In some embodiments, an LED actuates when input signals are received from signal circuit 604.

Upon receiving input signals from input/power circuit 606, controller 600 generates four separate outputs and a common 120 VAC, 5 amp maximum current. These outputs activate solenoid 164, and left, middle, and right solenoid 390. Flush input is controlled by white and orange/black; detergent is controlled by white and green/black; bleach is controlled by white and blue/black; and sour/softener is controlled by white and red/black color-coded output wires from controller 600.

The power supply for exemplary controller 600 may be a 120 VAC, 60 cycle, one phase current. One embodiment of controller 600 includes a green LED, which is activated when power is on. Exemplary controller 600 includes seven separate settings, each setting dip switch programmable, using about 12 switch modules. Separate time settings include: 1) pre-flush/post-flush (1–64 seconds each); 2) low/low detergent delay (1-512 inject, 315 delay); 3) high/high detergent delay (1-512 inject, 315 delay); 4) low bleach/low bleach delay (1-512 inject, 315 delay); 5) high bleach/high bleach delay (1-512 inject, 315 delay); 6) low sour, soft/low sour, soft delay (1-512 inject, 315 delay); and 7) high sour, soft/high sour, soft inject (1-512 inject, 315 delay). Exemplary terminals used with controller 600 and circuits 604 and 606 are quick-connect, clip type. Exemplary controller 600 may be equipped with one or more quick-connect terminals to receive and output signals from flush valve controls of another board in electrical communication with controller 600. A received signal (such as 5 VDC) would induce delayed chemical injection in one embodiment. When the signal from the other board ends, the injection could proceed as normal. However, software may be present to determine how much of a delay has been incurred and automatically subtract the value of the delay from any programmed injection delay (in cases where injection delay is used).

In use, supply hose fitting 156 is connected to a source of water at the use facility and containers 102, 104, and 106 are inverted into left, middle, and right bowl assemblies 400*a*, 400*b*, and 400*c*. The water provided may be within certain temperature ranges and pressure limits. Containers 102, 104, and 106 contain solid cast cleaning chemicals such as detergent, bleach, and sour/softener, respectively. A signal from the laundry machine in electrical communication with controller 600 activates controller 600. Controller 600 then sends a signal, opening valves in solenoid 164 and selected left, middle, and right solenoids 390*a*, 390*b*, and 390*c*. Such signals from the laundry machine may be to: 1) actuate left, middle, or right solenoid 390*a, b, c* separately; 2) actuate left and middle solenoids 390*a, b* only; 3) to actuate right solenoid 390*c* only; or 4) to actuate left and right solenoids 390*a, c* only. Middle and right solenoids 390*b, c* would not be actuated simultaneously in this embodiment to avoid conveying incompatible solutions to the laundry machine at the same time. Normally, solenoid 164 would be opened before opening any of left, middle, or right solenoids 390*a,*

*b, c*. Moreover, solenoid 164 would usually be left open for a specified time interval after left, middle, or right solenoids 390*a, b, c* were closed to allow all generated cleaning solutions to be delivered to the laundry machine.

Water flows through the valve in solenoid 164 to venturi 120 and into dividing chamber 364 as indicated in FIG. 6. A portion of the water flows from dividing chamber 364 through tubing members 384, 392*a, b, c* and 398*a, b*, three-way branch tees 388*a, b, c*, and solenoid valves 390*a*, 390*b*, and 390*c*. Solenoids 390*a*, 390*b*, and 390*c* are selectively opened to direct water to spray shutoff assemblies 396*a, b, c* to spray nozzles 442 of the respective bowl assemblies 400*a*, 400*b*, and 400*c*. The other portion of the water from dividing chamber 364 flows through first and second passageways 250 and 252, wherein partial vacuums are generated at the junction of first and second passageways 250 and 252 and respective first and second cavities 254 and 256. If one or more of containers 102, 104, or 106 were not inverted in the respective left, middle, or right bowl assemblies 450*a*, 450*b*, 450*c*, corresponding shutoff valve assemblies 396*a, b, c* would be in a closed position and water would not flow therethrough to spray nozzles 442.

Water selectively exits spray nozzles 442 in the form of a spray pattern 550 (see FIG. 8), which impinges on, and dissolves a portion of, the solid cast present in containers 102, 104, or 106, thereby selectively generating concentrated solutions. The concentrated solutions flow and are guided generally downwardly by inner surfaces of solution accumulator portions 458 and discharge portions 460 of bowls 452 and by inner surfaces of funnels 470 and conduits 474*a, b, c*.

The chemicals in exemplary containers 102 and 104 are selected to be compatible. Concentrated solutions from containers 102 and 104 are therefore channeled together, and may be thereby blended, where tubing members 480 and 482 converge into tubing member 490. Blended concentrated solutions from containers 102 and 104 then flow to second check valve assembly 496*b*. Check valve assemblies 496*a, b* permit fluids to flow toward venturi 120, but will not permit back flow in the opposite direction. From second check valve assembly 496*b*, blended concentrated solutions generated from containers 102 and 104 enter first cavity 254 of venturi 120. As selected, the concentrated solution generated from container 106 (not compatible with at least one of the chemicals in containers 102, 104) is likewise directed from right conduit 474*c* into tubing member 484, through first check valve assembly 496*a* to second cavity 256 of venturi 120.

Blended concentrated solutions from containers 102 and 104 and the unblended solution from container 106 are drawn into respective passageways 250 and 250 by partial vacuums, diluted therein and mixed, then directed into respective tubing members 516 and 518, where the solutions continue to flow separately, but not simultaneously to the laundry machine. As can be seen, separate pathways are maintained to prevent intermixture of incompatible chemicals.

It should be noted that components with greater or lesser angles and dimensions may be present in the device of this invention without departing from the spirit and scope of the present invention. Because numerous modifications may be made of this invention without departing from the spirit thereof, the scope of the invention is not to be limited to the embodiments illustrated and described. Rather the scope of the invention is to be determined by appended claims and their equivalence.

What is claimed is:

1. A laundry chemical dispenser fluidly coupled to a source of diluting liquid comprising:

at least two chemical solution generators for selectively generating at least two chemical solutions, the at least two chemical solutions being chemically interactive; and a stream splitter for inducting the at least two chemical solutions by venturi effect and for diluting the at least two chemical solutions and having a first independent discharge channel for discharging a diluted first chemical solution and further having a second independent discharge channel for discharging a diluted second chemical solution, said first and second discharge channels being non-intermixed.

2. The stream splitter of claim 1, further comprising a cap and a body, the cap and body being matable and cooperating to define the stream splitter chamber.

3. The stream splitter of claim 2, in which the cap portion at least partially accommodates the inlet channel and the first discharge channel.

4. The dispenser of claim 1, further comprising a first solenoid switch controlling flow of diluting liquid from the diluting liquid source to the stream splitter.

5. The dispenser of claim 4, further comprising a second solenoid switch disposed and configured to control the flow of diluting liquid downstream from the stream splitter.

6. The dispenser of claim 5, further comprising means for electrical communication between said first and second solenoid switches and a laundry machine.

7. The dispenser of claim 5, in which said electrical communication means comprises a logic circuit, the logic circuit generating electrical signals to the first or second solenoid switches in response to the electrical signals received from the laundry machine.

8. The dispenser of claim 1, each chemical solution generator comprising a bowl assembly configured to accommodate a solid cast cleaning chemical disposed in an inverted container.

9. The dispenser of claim 8, each chemical solution generator further comprising a nozzle configured to deliver a spray of the diluting liquid onto a surface of the solid cast cleaning chemical, thereby generating a chemical solution by dissolving a portion of the solid cast cleaning chemical.

10. The dispenser of claim 1, in which first, second, and third chemical solution generators are present.

11. A device for dividing a fluid solvent into a supply stream and a plurality of non-intermixed dilution streams and for diluting a plurality of concentrate fluid streams, comprising:

a fluid divider configured to divide the fluid solvent into the supply stream and said plurality of dilution streams; and a plurality of independent dilution stream pathways comprising a first dilution stream pathway and a second dilution stream pathway, each dilution stream pathway independently accommodating one of said dilution streams and a portion of a concentrate fluid pathway accommodating one of said concentrate fluid streams, each dilution stream pathway comprising structure for generating a partial vacuum proximate said concentrate fluid pathway to draw one of said concentrate fluid streams into the dilution stream pathway and thereby dilute the concentrate fluid stream.

12. The device of claim 11, comprising a cap and a body cooperating to define the fluid divider.

13. The device of claim 12, in which the cap is matable with the body.

14. The device of claim 12, further comprising a diffuser proportioned to be accommodated in the body and extending through each dilution pathway.

15. The device of claim 12, in which the body at least partially defines the dilution stream pathway.

16. The device of claim 12, in which the fluid divider is in fluid communication with an ingress bore and an egress bore, the fluid solvent entering the fluid divider via the ingress bore and a portion of the fluid solvent exiting the fluid divider via the egress bore.

17. The device of claim 16, further comprising a vacuum generating member disposed in each dilution stream pathway.

18. A device for generating cleaning solutions by spraying a solvent on first, second, and third solid casts and dissolving a portion thereof, the solid casts being disposed in respective first, second, and third inverted containers, the device blending compatible cleaning solutions and separately delivering incompatible cleaning solutions to a cleaning machine and comprising:

a divider-blender;

a first solvent supply pathway comprising apparatus for conveying a first stream of the solvent to the divider-blender;

a second solvent supply pathway comprising first, second, and third bowl assemblies accommodating respective first, second, and third inverted containers and apparatus for conveying a second stream of the solvent from the divider-blender to each bowl assembly;

separate first and second concentrated solution pathways, each concentrated solution pathway comprising apparatus for conveying at least one concentrated solution generated proximate one of said bowl assemblies to the blender-divider; and separate, non-intermixed first and second dilution pathways in fluid communication with respective first and second concentrated solution pathways, each dilution pathway comprising apparatus for diluting said concentrated solutions and for conveying said diluted solutions to the cleaning machine.

19. The device of claim 18, in which the divider-blender comprises a cap and a body, the cap and body being matable and cooperating to define a dividing cavity in fluid communication with the first and second solvent supply pathways and the first and second dilution pathways.

20. The device of claim 18, in which the second solvent supply pathway comprises a spray jet configured to direct a solvent spray onto each solid cast.

21. The method of claim 20, in which the first solenoid is opened before the at least one second solenoid is opened.

22. The method of claim 21, in which the first and second solenoids are closed in response to an electrical signal generated by the cleaning machine and in which the first solenoid is closed after the at least one solenoid is closed.

23. The device of claim 18, in which the first concentrated solution pathway comprises a tubular member communicating the divider-blender with said first and second bowl assemblies.

24. The device of claim 18, further comprising a diffuser disposable in said first and second dilution pathways.

25. The device of claim 18, the first solvent supply pathway comprising a first solenoid in electricsl communication with the cleaning machine.

26. The device of claim 25, the second solvent pathway comprising a main solvent pathway and first, second, and third branch solvent pathways, each branch solvent pathway being in fluid communication between one of said bowl assemblies and the main solvent pathway.

27. The device of claim 26, each branch solvent pathway comprising a second solenoid in electrical communication with the cleaning machine.

28. A method of providing at least one diluted cleaning solution to a cleaning machine, comprising:

providing the device of claim 26; and actuating the first solenoid and at least one second solenoid, thereby generating at least one concentrated cleaning solution by impinging a quantity of a solvent upon at least one of said first, second, and third solid casts, the at least one concentrated cleaning solution thereafter being diluted and conveyed to the cleaning machine.

29. The method of claim 28, in which the first and second solenoids are opened in response to an electrical signal generated by the cleaning machine.

30. The method of claim 28, in which the diluted cleaning solution generated is selected from the group consisting of a detergent solution, a bleach solution, a sour/softener solution, or any compatible combination thereof.

* * * * *